United States Patent [19]

Morgan

[11] 4,247,516

[45] Jan. 27, 1981

[54] METHOD OF MAKING PRESTRESSED CONCRETE POLES, TUBES, AND SUPPORT COLUMNS

[75] Inventor: Burton D. Morgan, Hudson, Ohio

[73] Assignee: Top Roc Precast Corporation, Hudson, Ohio

[21] Appl. No.: 126,906

[22] Filed: Mar. 3, 1980

[51] Int. Cl.[3] ..... B28B 21/34; B28B 1/20; B28B 1/30

[52] U.S. Cl. ..... 264/503; 264/228; 425/111; 425/435

[58] Field of Search ..... 264/228, 503; 425/111, 425/435

[56] References Cited

U.S. PATENT DOCUMENTS

| | | | |
|---|---|---|---|
| 2,395,216 | 2/1946 | Fitzpatrick | 425/111 X |
| 2,474,660 | 6/1949 | Fitzpatrick | 264/228 X |
| 2,865,078 | 12/1958 | Hasselblad | 425/111 |
| 3,583,047 | 6/1971 | Uchiyama | 264/228 X |
| 3,692,889 | 9/1972 | Hetrich | 264/503 |
| 4,009,982 | 3/1977 | Maier | 425/392 X |
| 4,044,088 | 8/1977 | Hume | 264/228 X |
| 4,113,823 | 9/1978 | Jida | 264/228 X |

*Primary Examiner*—J. Howard Flint, Jr.

*Attorney, Agent, or Firm*—Oldham, Oldham, Hudak & Weber

[57] ABSTRACT

A method of making a prestressed concrete pole, including placing a heat softenable plastic pipe in a metal tube or pipe and filling the space between the pipes with concrete, rotating the metal pipe-concrete assembly rapidly to center the plastic pipe therein, applying hot fluid pressure to the interior of the plastic pipe, longitudinally prestressing the concrete pipe assembly for several hours while the concrete sets, and gradually releasing the fluid pressure and prestressing pressure to obtain a prestressed concrete pole.

7 Claims, 4 Drawing Figures

METHOD OF MAKING PRESTRESSED CONCRETE POLES, TUBES, AND SUPPORT COLUMNS

BACKGROUND OF THE INVENTION

Heretofore, there have been many commercial articles made from prestressed concrete materials. These articles may include tubular pipes, beams, support columns, etc., and the concrete may include reinforcing rods, bars, and/or tubes therein. A large number of such prestressed concrete-metal reinforced articles have been made heretofore. Naturally, it is always desirable to make improved concrete products at reduced costs, or to obtain better physical properties in such products by novel production steps.

It is the general object of the present invention to provide an improved process for forming hollow prestressed concrete articles, such as poles, which have a metal outer shell.

Another object of the invention is to provide prestressed concrete columns, tubes, or poles positioned in metal enclosure tubes and which have desirable physical properties.

Another object of the invention is to provide an improved method for obtaining prestressed concrete poles which are made by substantially conventional apparatus and including using a corregated thin wall metal enclosure tube in forming the concrete poles.

The foregoing and other objects and advantages of the invention will be made more apparent as the specification proceeds.

Reference now is particularly directed to the accompanying drawings, wherein.

When referring to corresponding members and steps shown in the drawing, and referred to in the specification, corresponding numerals are used to facilitate comparison therebetween.

SUBJECT MATTER OF THE INVENTION

The present invention, as one embodiment thereof, relates to a method of making a prestressed concrete pole having a hollow interior and a metal tube outer wall having transversely extending corrugations therein comprising steps of coating the inner wall of the metal pipe or tube with a liquid epoxy plastic, placing a heat softenable plastic pipe in the metal tube on the longitudinal axis thereof and filling the space between the pipes with concrete, rotating the metal pipe rapidly to center the plastic pipe in the concrete in the metal pipe, applying hot fluid pressure to the plastic pipe interior to expand it and apply expanding pressure on the metal pipe through the concrete, longitudinally prestressing the concrete pipe assembly and establishing tension in the outer metal shell which remains for the life of the structure. By having the tension at the outside diameter it is in its most effective position, and maintaining the stress for several hours while the concrete is setting, and releasing the fluid pressure.

Figure 1:
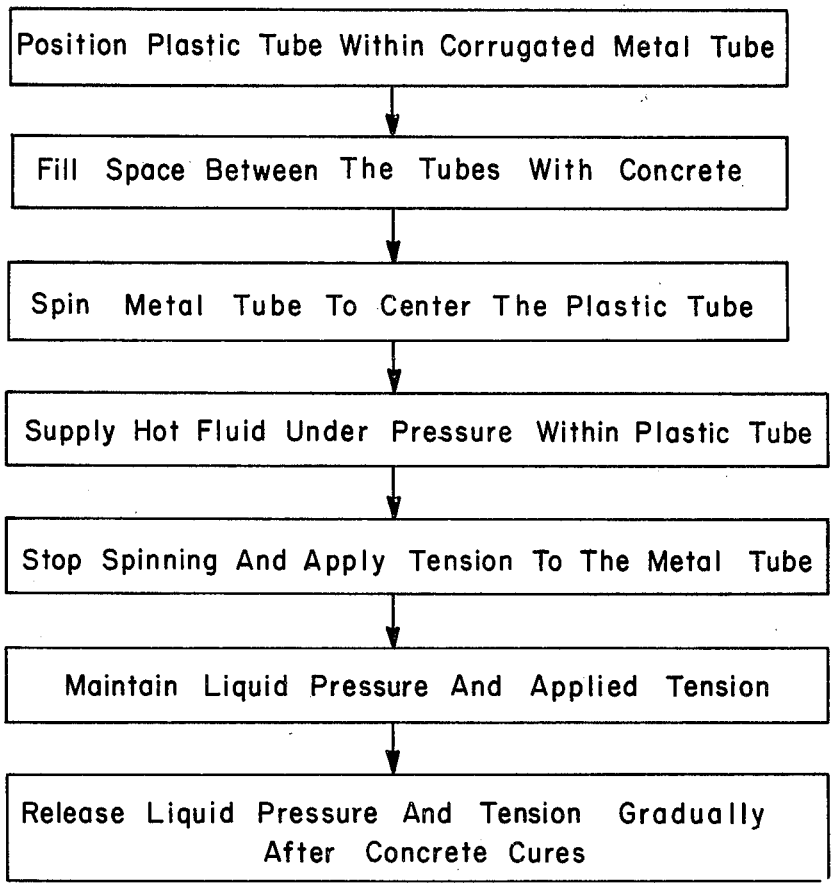
FIG. 1 is a diagrammatic flow diagram chart of the method of the invention of making a prestressed concrete pole.
Figure 2:
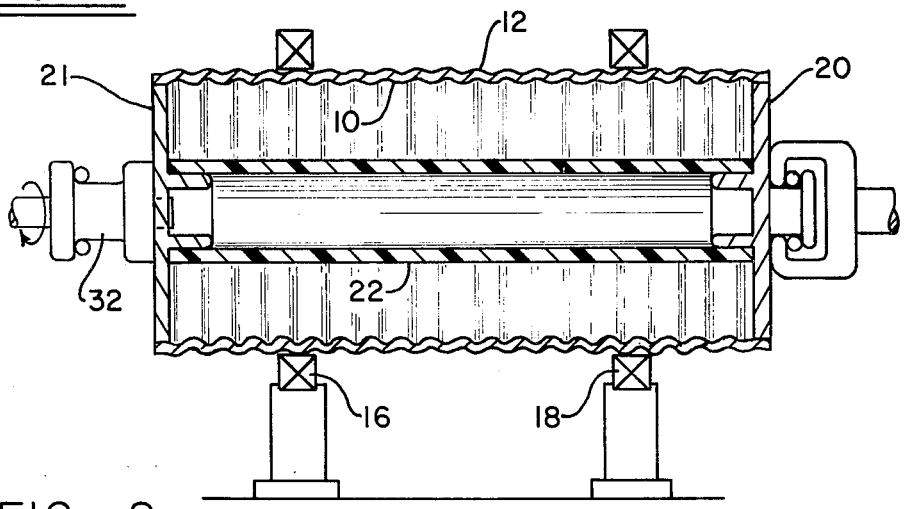
FIG. 2 is a diagrammatic view of apparatus involved in the first step of forming a prestressed concrete pole in accordance with the principles of the invention.

Attention now is particularly directed to the details of the structure shown in the drawings, and FIG. 2 shows a metal pipe or tube 10 which preferably has transversely directed corrugations 12 formed therein, which tube is made from a suitable metal, usually steel, and which tube or pipe has a thin metal wall of, for example, about 1/16 inches thick. Furthermore, the tube has the corrugations 12 therein which are relatively flat. The tube can expand lengthwise and have its corrugations flattened slightly during the manufacturing operations, as outlined hereinafter in more detail.

As an initial step, the interior of the metal tube 10 is coated with a two-part epoxy liquid solution. This epoxy is a special adhesive provided by Adhesive Engineering Company of San Carlos, Calif., and is particularly adapted for aiding in the bonding of concrete to metal such as the wall of the tube 10. The epoxy can be mixed and placed in the tube while the tube 10 is supported, for example, on a pair of suitable bearing units 16 and 18. These bearings 16 and 18 can be supported in any desired manner and usually it is preferred to have end caps 20 and 21 on the metal tube 10 after the epoxy material has been poured thereinto. Then the metal tube can be suitably rotated on its longitudinal axis, as by means indicated in FIG. 2, so as to spread the epoxy material into a uniform coat on the interior wall surface of the tube 10, and any excess plastic can be poured from an end of the tube.

Next, a plastic pipe 22 is placed on the center axis of the tube 10. This plastic pipe is made from a heat softenable material, usually polyethylene, and it can be supported on the end caps. Then concrete is poured into the metal pipe-plastic pipe assembly by removing one of the end caps and introducing liquid concrete after which the end caps 20, 21, or similar members, are engaged with the metal pipe assembly. Any desired removable cap or opening can be provided in one or both of the end caps to enable liquid concrete to be introduced into the assembly of the metal tube and plastic tube until the space between these tubes is filled. This filling of the tube 10 with concrete should occur before the epoxy plastic on the metal pipe wall has set.

Figure 3:
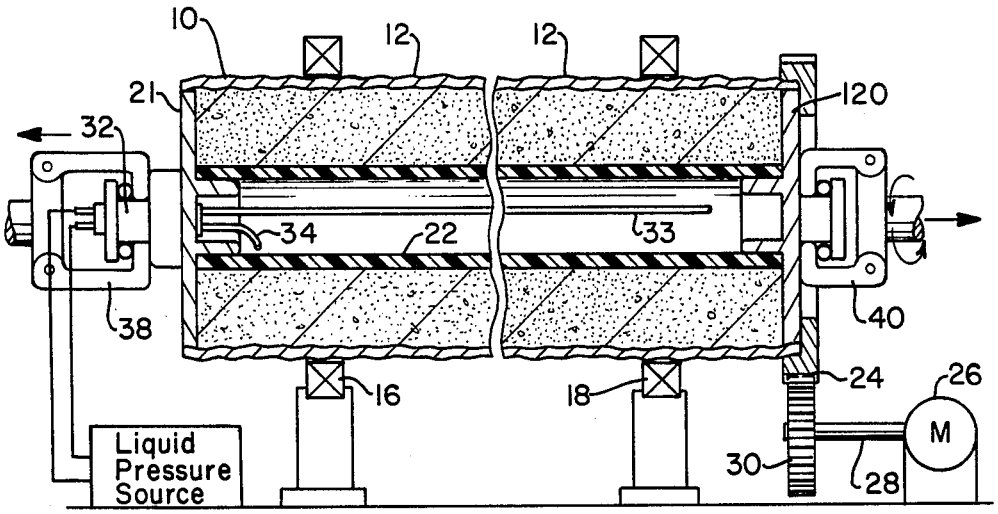
FIG. 3 is a diagrammatic view of other apparatus and means used in the further processing, rotating, and tensioning the article of the invention during its manufacture.
Figure 4:
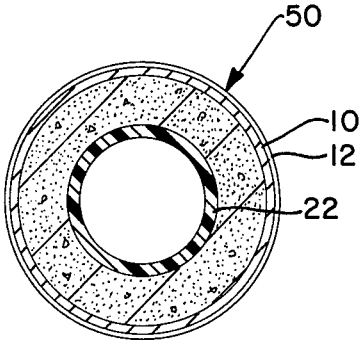
FIG. 4 is a cross-sectional view of the article in FIG. 3.

FIG. 3 of the drawings shows that a pipe cap 120 may have suitable ring gear 24 formed thereon, and a motor 26 by its output drive shaft 28, with a drive gear 30 thereon, engages this ring gear 24 so that the assembly of the concrete, metal tube and plastic tube can be rapidly rotated in the annular bearings 16 and 18 at a relative speed, such as about 2,000 rpm's. Such high-speed rotation and the centrifugal action provided thereby centers the plastic pipe 22 in the metal tube or pipe 10. Obviously the concrete pipe assembly of FIG. 3 can be supported and rotated on its longitudinal axis in any conventional manner. After about 2 or 3 minutes of rotation of the assembly shown in FIG. 2, the plastic pipe should be positively located or centered on the longitudinal axis of the metal tube 10 and then a hot fluid such as hot water is supplied under pressure to this plastic pipe 22, as through a rotary coupling 32. This rotary coupling 32 has inlet and outlet tubes 33 and 34 connected thereto and extending therefrom, whereby a hot fluid, usually water, can be circulated around under pressure in this plastic pipe to soften it, and the pressure will, naturally, expand this polyethylene pipe and exert radially outwardly directed pressures on the concrete and on the wall of the metal tube 10. After spinning this tube 10 and the assembled materials therein, under the pressurized conditions described, for about 10 minutes, then a longitudinally prestressing tensioning force is applied to the metal tube-concrete assembly. Hence, I have shown diagrammatically jaws 38 for engaging one end of the assembly, and a second set of jaws 40 for engaging the opposite end of the metal tube-concrete assembly. These gripper jaws 38 and 40 of any suitable construction to be moved into engagement with the tube 10 and its contents. The jaws are connected to a conventional tensioning machine not shown for exerting tension on this unit of the invention. Rotation of the tube and concrete assembly can be terminated prior to tensioning the assembly longitudinally. Preferably the hot liquid pressure applied to the concrete-metal tube assembly is maintained in effect for about two to three hours and, at the same time, the prestressing tensioning forces are applied to the assembly for about three hours or longer. Then the prestress tensioning forces, which may amount to about a 20-ton pull, as used in forming prestressed concrete poles on conventional size, is gradually released over a period of five to ten minutes. Such article formed, for example, may be about 60 feet long, and be of a suitable outer diameter, and center bore size.

After these tensioning forces are released, the end caps on the pole are removed, the bearings 16 and 18 are released, and a finished concrete tubular pole 50 can be removed from the apparatus and is ready for use.

The pressure applied by the hot water may be, for example, about 3000 lbs. per square inch and any conventional rotary coupling can connect the pressure supply lines to the concrete article being produced. It is expected that the pole will grow 12 to 18 inches in length due to the fluid pressure and longitudinal tension force.

By the apparatus and method of the invention, a good bond is obtained between the concrete and the tube 10, and some flattening of the corrugations in the metal tube is effected, as indicated in FIG. 3. This aids in obtaining the desired density and stresses in the concrete material as it sets up and cures in making the finished tube 50 of the invention. The metal tube is made at reasonable cost and has very desirable support properties, in addition to being the actual tensioning member and provides a durable, smooth outer surface pole. Due to the fortunate location (at the outer surface of the pole) it is calculated that only $\frac{2}{3}$ the weight of steel normally used as tensioning wire in prestressed poles will produce the same strength pole. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. A method of making a prestressed concrete pole comprising the steps of coating the inner wall of metal tube with a liquid epoxy plastic material, placing a heat softenable plastic pipe in a concentric position in the metal pipe and filling the space between the pipes with concrete, rotating the metal pipe rapidly to center the plastic pipe therein and compact the concrete, applying hot fluid pressure to the plastic pipe interior to soften and expand such plastic pipe and to place expanding pressure on the metal pipe, and to further compact the concrete, longitudinally prestressing the concrete-pipe assembly for several hours while the concrete sets, and releasing the fluid pressure and prestressing pressure to obtain a prestressed concrete pole.

2. A method of making a prestressed concrete pole as in claim 1 where radial corrugations are present in said metal tube, and they are partly flattened during formation of the concrete pole.

3. A method of making a prestressed concrete pole as in claim 1 or 2 and including filling the metal tube with concrete before the epoxy plastic has set up.

4. A method of making a prestressed concrete pole as in claim 1 or 2 and including maintaining the hot fluid pressure and longitudinal stress on the concrete pipe assembly for at least about three hours and releasing such pressure and stress.

5. A method of making a prestressed concrete pole comprising the steps of uniformly coating the inner wall of a metal tube with a liquid adhesive, a heat softening plastic pipe being positioned in the metal pipe on its longitudinal axis, filling the metal pipe with fluid concrete which encompasses the plastic pipe, rotating the metal pipe rapidly to center the plastic pipe in said metal pipe and the concrete therein, applying hot liquid pressure to the plastic pipe interior causing the metal outer pipe to prestress itself, longitudinally stressing the concrete-pipe assembly before the concrete sets, and adding to the prestressing done by the previous fluid pressure, and releasing the two prestressing pressures to obtain a prestressed concrete pole.

6. A method of making a prestressed concrete article, such as a pole, as in claim 5 and including continuing the rotation of the metal pipe and its contents for a few minutes while applying the liquid pressure, and stopping the rotation before applying the longitudinal stress thereto.

7. A method as in claim 6 and including using a metal tube with transversely extending corrugations therein, and stretching the metal tube to tension it and maintaining such tension by the concrete as it sets.

* * * * *